US005326684A

United States Patent [19]

Aotsuka

[11] Patent Number: 5,326,684

[45] Date of Patent: Jul. 5, 1994

[54] HEAT-DEVELOPABLE COLOR PHOTOSENSITIVE MATERIAL CONTAINING CALCIUM IN AN AMOUNT OF AT LEAST 2000 PPM BASED ON TOTAL BINDER WEIGHT

[75] Inventor: Yasuo Aotsuka, Kanagawa, Japan

[73] Assignee: Fuji Photo Film Co., Ltd., Kanagawa, Japan

[21] Appl. No.: 3,492

[22] Filed: Jan. 12, 1993

[30] Foreign Application Priority Data

Jan. 13, 1992 [JP] Japan ..... 4-023165

[51] Int. Cl.[5] ..... G03C 1/00

[52] U.S. Cl. ..... 430/617; 430/642; 430/628; 430/545; 430/351; 430/203

[58] Field of Search ..... 430/642, 628, 617, 545, 430/351, 203

[56] References Cited

U.S. PATENT DOCUMENTS

| | | | |
|---|---|---|---|
| 4,500,626 | 2/1985 | Naito et al. | 430/203 |
| 4,605,609 | 8/1986 | Okazaki et al. | 430/642 |
| 5,077,179 | 12/1991 | Abe et al. | 430/372 |
| 5,206,131 | 4/1993 | Matsuda et al. | 430/203 |

FOREIGN PATENT DOCUMENTS 3174142 7/1991 Japan .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

In a heat-developable color photosensitive material comprising a photosensitive silver halide, a dye providing compound, and a binder on a support, the content of calcium is controlled to 500 ppm or more based on the total weight of the binder, allowing the use of inexpensive binders. The photosensitive material is cost effective and forms an image with a low fog density (Dmin) and a high image density (Dmax).

14 Claims, No Drawings

HEAT-DEVELOPABLE COLOR PHOTOSENSITIVE MATERIAL CONTAINING CALCIUM IN AN AMOUNT OF AT LEAST 2000 PPM BASED ON TOTAL BINDER WEIGHT

BACKGROUND OF THE INVENTION

1. Field of the Invention

This invention relates to a heat-developable color photosensitive material and more particularly, to a low-cost heat-developable color photosensitive material providing a color image having a high image density and clear white areas.

2. Prior Art

Heat developable photosensitive materials and their image forming processes are well known in the art and described in the literature, inter alia, "Fundamentals of Photographic Engineering—Non-Silver Salt Photography—", Corona Publishing K.K., Tokyo, Japan (1982), pages 242–255.

A number of proposals have been made foe forming color images through heat development. For example, U.S. Pat. No. 3,531,286, 3,761,270 and 4,021,240, Belgian Patent No. 802519, and Research Disclosure, September 1979, pages 31–32 propose processes for forming color images through coupling of developing agent oxidants with couplers.

These heat-developable color photosensitive materials for forming color images, however, suffer from the serious problem that white areas are gradually colored upon exposure to intense light or long-term storage since the materials are of the non-fixation type and have silver halide left even after image formation. Further the above-mentioned processes require a relatively long time for development to complete and result in less desirable images having substantial fog and a low image density.

To overcome these drawbacks, U.S. Pat. No. 4,500,626, 4,483,914, 4,503,137 and 4,559,920 and Japanese Patent Application Kokai (JP-A) No. 165054/1984 propose to form or release a diffusible dye imagewise by heating and to transfer the diffusible dye to a mordanted image-receiving material with the aid of water or other suitable solvents.

This process still required relatively high development temperatures and the photosensitive material was not satisfactory in aging stability. In this regard, it was proposed to carry out heat development in the presence of a base or base precursor and a minor amount of water, followed by dye transfer for development promotion, development temperature lowering and simpler processing purposes (see JP-A 218443/1984 and 238056/1986 and EP 210,660 A2).

A variety of proposals have been made in the art for producing positive color images through heat development. For example, U.S. Pat. No. 4,559,290 proposes a method for forming an image by converting a dye providing (DRR) compound into an oxidized form having no dye releasing ability, preparing a heat-developable material in which the oxidized DRR compound is co-present with a reducing agent, carrying out heat development to oxidize the reducing agent in an amount corresponding to the exposure of silver halide, and allowing the remainder of the reducing agent unoxidized to reduce the oxidized DRR compound into the DRR compound to release a diffusible dye. EP 220,746 A2 and Japan Invention Society's Kokai Giho (Technical Report) No. 87-6199 (Vol. 12, No. 22) describe a heat-developable color photosensitive material including a compound capable of releasing a diffusible dye through a similar mechanism, that is, a compound capable of releasing a diffusible dye through reductive cleavage of a N-X bond wherein X is an oxygen atom, nitrogen atom or sulfur atom.

In heat-developable color photosensitive materials as mentioned above, a variety of polymers can be used as a binder. However, many polymers provide images with a low image density (Dmax) or high fog density (Dmin). It is difficult to find a compromise polymer between cost and image quality.

One known preferred class of polymer is gelatin. However, heat-developable color photosensitive materials using delimed gelatin are unsatisfactory in both Dmin and Dmax.

SUMMARY OF THE INVENTION

Therefore an object of the present invention is to provide a heat-developable color photosensitive material of low cost which produces images with high Dmax and low Dmin.

The present invention is addressed to a heat-developable color photosensitive material comprising at least a photosensitive silver halide, a dye providing compound, and a binder on a support. According to the present invention, calcium is present in the photosensitive material in an amount of at least 500 parts by weight per million parts by weight of the total binder.

DETAILED DESCRIPTION OF THE INVENTION

The heat-developable color photosensitive material contains at least 500 ppm, preferably at least 1,000 ppm, more preferably at least 2,000 ppm of calcium based on the total weight of the binder. The upper limit is preferably about 10,000 ppm of calcium although larger amounts are acceptable as the case may be. Extremely large contents of calcium, however, have the problems that coating solutions used in the preparation of photosensitive material tend to become turbid or settle a precipitate and thus become poor in filtration and that during continuous processing, the photosensitive material coatings absorb a varying quantity of water which causes variations in photographic property.

The binders used in conventional heat-developable color photosensitive material are hydrophobic polymers as typified by gelatin. Some of the polymers, especially delimed gelatin, can adversely affect photographic property.

The inventor has found that the calcium content polymer dictates photographic property. Better photographic property is achievable by controlling the calcium content to the above-defined range. The inventor has first discovered that the calcium content in polymer is related to photographic property. By controlling the calcium content in accordance with the present invention, any cost effective polymer can be used at no sacrifice of photographic property, leading to a cost reduction.

Calcium is contained in heat-developable color photosensitive material by any suitable means, for example, by using a calcium laden polymer as a partial or sole binder, by adding a calcium compound to a coating solution or solutions, by incorporating a calcium compound in a dye-providing compound dispersion or silver halide emulsion, or by overcoating a calcium compound-containing solution onto a coated photosensitive film. A combination of two or more of these means is also useful.

Any desired calcium compounds may be used herein insofar as they are soluble in water, acids, alkalis, alcohols or the like and thus can be added in solution form. Exemplary calcium compounds include $CaCl_2$, $CaBr_2$, $CaO_2$, $Ca(OH)_2$, $CaSO_4$, $Ca(NO_3)_2$, $Ca_3(PO_4)_2$, $CaCO_3$, $Ca(CH_3COO)_2$, and hydrates thereof. These compounds may be used alone or in admixture of two or more.

The calcium compound may be added to any constituent layer of photosensitive material. Namely, it may be effectively added to any desired layer or layers including a silver halide-containing layer, dye-providing compound-containing layer, intermediate layer and protective layer.

Such a calcium compound is added when the calcium content off a polymer or other constituents used in the preparation of photosensitive material is below the above-defined range. Therefore, the calcium content off a polymer or other constituents should be quantitatively determined before the preparation of photosensitive material. Such quantitative determination may be done by EDTA titration, atomic absorption spectroscopy or the like.

The binder used herein will be described later.

Basically, the heat-developable color photosensitive material of the invention includes a photosensitive silver halide, a dye-providing compound (which can be a reducing agent in some cases as will be described later), a binder, and optionally an organic metal salt oxidizing agent on a support. These ingredients are often added to a common layer although they may be added to separate layers if they can react with each other. For example, a colored dye-providing compound may be added to a layer underlying a silver halide emulsion layer for preventing a sensitivity lowering. A reducing agent is preferably incorporated in the heat-developable color photosensitive material although it can be supplied from the outside, for example, through diffusion from a dye-fixing material as will be described later.

In order to provide a wide range of color on a chromaticity diagram using three primary colors of yellow, magenta and cyan, at least three silver halide emulsion layers having photosensitivity in different spectrum regions are used in combination. Exemplary are a combination of blue, green and red-sensitive layers, a combination of green, red and infrared-sensitive layers, and a combination of red, first infrared and second infrared-sensitive layers. These photosensitive layers may be arranged in any desired one of the orders known for conventional color photosensitive materials. Each photosensitive layer may be divided into two or more sublayers, if desired.

The heat-developable color photosensitive material may further include various subordinate layers such as protective, undercoating, intermediate, yellow filter, infrared filter, anti-halation, and backing layers.

In the present invention, calcium may be contained in any of these layers or added to any of these layers as previously described.

The silver halide which can be used herein includes silver chloride, silver bromide, silver iodobromide, silver chlorobromide, silver chloroiodide, and silver chloroiodobromide.

The silver halide emulsions used herein may be either of the surface latent image type or of the internal latent image type. The internal latent image type emulsion is used as a direct reversal emulsion in combination with a nucleating agent or secondary exposure. Also employable is a so-called core-shell emulsion in which a core and a surface shell of each of grains have different phases. The silver halide emulsion may be either mono-dispersed or multi-dispersed, and a mixture of mono-dispersed emulsions may also be used. The grain size preferably ranges from about 0.1 to about 2 μm, more preferably from about 0.2 to about 1.5 μm. The crystal habit of silver halide grains may be of a cubic, octahedral, tetradecahedral (14-sided), or plate shape having a high aspect ratio, but is not limited thereto.

More illustratively, use may be made of any of the silver halide emulsions described in U.S. Pat. No. 4,500,626, col. 50, U.S. Pat. No. 4,628,021, RD 17029 (1978), and JP-A 253159/1987.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogenous heterocyclic compound as disclosed in JP-A 253159/1987.

The amount of the photosensitive silver halide coated preferably ranges from about 1 mg to about 10 g of silver per square meter.

In the practice of the invention, an organic metal salt may be used as an oxidizing agent along with the photosensitive silver halide. Organic silver salts are preferred among these organic metal salts. Useful examples of the organic compounds which can be used to form the organic silver salt oxidizing agents are benzotriazoles, fatty acids and other compounds as described in U.S. Pat. No. 4,500,626, columns 52–53. Also useful are silver salts of carboxylic acids having an alkynyl radical such as silver phenylpropiolate as described in JP-A 113235/1985 and silver acetylene as described in JP-A 249044/1986. A mixture of two or more organic silver salts may be used.

The organic silver salt is used in an amount of from about 0.0001 to about 10 mol, preferably from about 0.001 to about 1 mol per mol of photosensitive silver halide. The combined amount of the photosensitive silver halide and organic silver salt coated preferably ranges from about 50 mg to about 10 grams of silver per square meter.

In the practice of the present invention, various antifoggants or photographic stabilizers may be used. Examples are azoles and azaindenes as described in RD 17643 (1978), pages 24–25, nitrogenous carboxylic acids and phosphoric acids as described in JP-A 168442/1984, mercapto compounds and metal salts thereof as described in JP-A 111636/1984, and acetylene compounds as described in JP-A 87957/1987.

The silver halides used herein may be spectrally sensitized with methine dyes and other dyes. The dyes useful for spectral sensitization include cyanine dyes, merocyanine dyes, complex cyanine dyes, complex merocyanine dyes, holopolar cyanine dyes, hemicyanine dyes, styryl dyes, and hemioxonol dyes. Illustrative examples are the sensitizing dyes disclosed in U.S. Pat. No. 4,617,257, JP-A 180550/1984 and 140335/1985 and RD 17029 (June 1978), pages 12–13. These sensitizing dyes may be used individually or as a combination thereof. A combination of sensitizing dyes is frequently used for supersensitization.

In addition to the sensitizing dye, the emulsion may contain a dye which itself has no spectral sensitization function or a compound which does not substantially absorb visible light, but is capable of supersensitization. Such supersensitizing compounds are disclosed in U.S. Pat. No. 3,615,641 and Japanese Patent Application No. 226294/1986.

These sensitizing dyes may be added to the emulsion during, before or after chemical ripening, or before or after nucleation of silver halide grains according to the teachings of U.S. Pat. Nos. 4,183,756 and 4,225,666. The amount of the sensitizing dye is generally from about $10^{-8}$ to about $10^{-2}$ mol per mol of the silver halide.

The binders employed in layers of the photosensitive material and dye-fixing material may be hydrophilic. Typical examples are described in JP-A 253159/1987, pages 26–28. More particularly, the preferred binder is a transparent or translucent hydrophilic binder, examples of which include natural substances, for example, proteins such as gelatin, e.g., delimed gelatin and limed gelatin, and gelatin derivatives, cellulose derivatives, and polysaccharides such as starch, dextran, pluran, gum arabic, etc.; and synthetic polymers such as polyvinyl alcohol, polyvinyl pyrrolidone, acrylamide polymer, etc. Another example of the synthetic polymer is a polymer having a high water-absorbing capacity as described in JP-A 245260/1987, that is, a homopolymer of a vinyl monomer having —COOM or —$SO_3M$ wherein M is hydrogen or an alkali metal or a copolymer of such vinyl monomers or a copolymer of such a vinyl monomer with another vinyl monomer, for example, sodium methacrylate, ammonium methacrylate, and Sumikagel L-5H manufactured and sold by Sumitomo Chemical K.K. of Japan. The binders may be used alone or in admixture of two or more.

Particularly in a system of carrying out heat development in the presence of a small amount of water, the use of a highly water-absorbing polymer as mentioned above enables rapid water absorption. The highly water-absorbing polymer, when used in a dye-fixing layer or a protective layer therefor, is also effective in preventing the once transferred dye from being re-transferred from the dye-fixing element to another layer.

The binders may be coated in amounts of up to about 20 grams per square meter, preferably up to about 7 grams per square meter, and most preferably up to about 4 grams per square meter of photosensitive material.

A variety of polymer latexes may be contained in layers (including a back layer) of the photosensitive material or dye-fixing element for the purposes of improving film physical properties, for example, increasing dimensional stability and preventing curling, adhesion, film crazing, pressure sensitization or desensitization. Useful examples are the polymer latexes described in JP-A 245258/1987, 136648/1987, and 110066/1987. Particularly, addition of a polymer latex having a low glass transition temperature of up to 40° C. to a mordant layer is useful in preventing the mordant layer from crazing. Addition of a polymer latex having a high glass transition temperature to a back layer is useful in preventing curling.

There may be used any of the reducing agents which are known in the field of heat-developable color photosensitive materials. Also included are dye providing substances having reducing nature as will be described later (in this case, another reducing agent may be additionally used). Also useful are reducing agent precursors which themselves have no reducing nature, but exert reducing nature under the action of nucleophilic reagents or heat during development step.

Examples of the reducing agent and precursor are described in the following patents.

| | | |
|---|---|---|
| U.S. Pat. No. 4,500,626, col. 49–50, | | |
| U.S. Pat. No. 4,483,914, col. 30–31, | | |
| U.S. Pat. No. 4,330,617 and 4,950,152 | | |
| JP-A 140335/1985 | 40245/1982 | 138736/1981 |
| 178458/1984 | 53831/1984 | 182449/1984 |
| 182450/1984 | 119555/1985 | 128436/1985 |
| 128437/1985 | 128438/1985 | 128439/1985 |
| 198540/1985 | 181742/1985 | 259253/1986 |
| 244044/1987 | 131253/1987 | 131254/1987 |
| 131255/1987 | 131256/1987 | |
| EP 220746 A2 | | |

Also useful are combinations of reducing agents as disclosed in U.S. Pat. No. 3,039,869.

Where a non-diffusible reducing agent is used, an electron transfer agent and/or an electron transfer agent precursor may be used for promoting electron transfer between the non-diffusible reducing agent and developable silver halide, if desired. The electron transfer agents and precursors thereof may be selected from the above-mentioned reducing agents and precursors thereof. The electron transfer agent or precursors thereof should preferably have greater mobility than the non-diffusible reducing agent (electron donor). Useful electron transfer agents are 1-phenyl-3-pyrazolidones and aminophenols.

The non-diffusible reducing agent (electron donor) which is combined with the electron transfer agent may be selected from those of the above-mentioned reducing agents which are substantially immobile in a layer of photosensitive material, preferably hydroquinones, sulfonamidophenols, sulfonamidonaphthols, and the compounds described as the electron donor in JP-A 110827/1978, and dye providing substances having non-diffusion and reducing properties to be described later. The reducing agent is generally added in an amount of 0.01 to 20 mol, preferably 0.1 to 10 mol per mol of silver.

In the photosensitive material of the present invention, there may be contained a compound which, when silver ion is reduced into silver at elevated temperatures, produces or releases a mobile or diffusible dye in direct or inverse proportion to the reaction. These compounds are simply referred to as dye-providing compounds or substances.

Typical of the dye-providing substance are compounds capable of forming dyes through oxidative coupling reaction (or couplers). The couplers may be either four or two-equivalent couplers. Useful are two-equivalent couplers having a non-diffusible group as a splittable group and capable of forming a diffusible dye through oxidative coupling reaction. The non-diffusible group may form a polymeric chain. Illustrative examples of the color developing agents and couplers are described in, for example, T. H. James, "The Theory of the Photographic Process", 4th Ed., pages 291–334 and 354–361, and the following Japanese laid-open specifications.

| | | |
|---|---|---|
| JP-A 123533/1983 | 149046/1983 | 149047/1983 |

-continued

| | | |
|---|---|---|
| 111148/1984 | 124399/1984 | 174835/1984 |
| 231539/1984 | 231540/1984 | 2950/1985 |
| 2951/1985 | 14242/1985 | 23474/1985 |
| 66249/1985 | | |

Another class of dye-providing compounds includes compounds having the function of releasing or diffusing a diffusible dye imagewise. The compounds of this type may be represented by the following formula [L I]:

$$(Dye\text{-}Y)_n\text{—}Z \qquad [L\ I]$$

wherein Dye represents a dye group, a temporarily wavelength shortened dye group or a dye precursor group; Y represents a valence bond or a connecting linkage; and Z represents a group which, in correspondence or counter-correspondence to photosensitive silver salt having a latent image distributed imagewise, produces a difference in diffusibility of the it compound represented by $(Dye\text{-}Y)_n$—Z or releases Dye, the diffusibility of Dye released being different from that of the compound represented by $(Dye\text{-}Y)_n$—Z; and n represents an integer of 1 or 2, when n=2, the Dye-Y's may be the same or different.

Illustrative examples of the dye providing compound of formula [L I] are given below as classes (1) to (5). It is to be noted that the compounds of classes ( 1 ) to ( 3 ) are those forming a diffusible dye image (positive dye image) in counter proportion to the development of silver halide and the compounds of classes (4) to (5) are those forming a diffusible dye image (negative dye image) in proportion to the development of silver halide.

Class (1): Dye developing reagents in the form of a hydroquinone-type developing reagent having a dye moiety attached thereto are disclosed in U.S. Pat. Nos. 3,134,764; 3,362,819; 3,597,200; 3,544,545; and 3,482,972. These dye developing reagents are diffusible in an alkaline environment and become non-diffusible upon reaction with silver halide.

Class (2): Non-diffusible compounds which release diffusible dyes in an alkaline environment, but lose the ability upon reaction with silver halide are described in U.S. Pat. No. 4,503,137. Examples are substances which release a diffusible dye through intramolecular nucleophilic substitution reaction as disclosed in U.S. Pat. No. 3,980,479, and substances which release a diffusible dye through intramolecular rewind reaction of an isooxazolone ring as disclosed in U.S. Pat. No. 4,199,354.

Class (3) includes compounds which release a diffusible dye through reaction with the reducing agent which has left non-oxidized by development as disclosed in U.S. Pat. Nos. 4,559,290 and 4,783,396, EP 220746 A2, and Technical Report 87-6199.

Examples are compounds which release a diffusible dye through intramolecular nucleophilic substitution reaction after reduction as disclosed in U.S. Pat. Nos. 4,139,389 and 4,139,379, JP-A 185333/1984 and 84453/1982; compounds which release a diffusible dye through intramolecular electron transfer reaction after reduction as disclosed in U.S. Pat. No. 4,232,107, JP-A 01649/1984 and 88257/1986, Research Disclosure 24025 (1984); compounds which release a diffusible dye through cleavage of a single bond after reduction as disclosed in German Patent 30 08 588A, JP-A 142530/1981, U.S. Pat. Nos. 4,343,893 and 4,619,884; nitro compounds which release a diffusible dye upon receipt of an electron as disclosed in U.S. Pat. No. 4,450,223; and compounds which release a diffusible dye upon receipt of an electron as disclosed in U.S. Pat. No. 4,609,610.

Preferred examples are compounds having a N-X bond wherein X is an oxygen, sulfur or nitrogen atom and an electron attractive group in a molecule as disclosed in EP 220746 A2, Technical Report 87-6199, U.S. Pat. No. 4,783,396, JP-A 201653/1988 and 201654/1988; compounds having a $SO_2$-X bond wherein X is as defined above and an electron attractive group in a molecule as disclosed in Japanese Patent Application No. 106885/1987; compounds having a PO-X bond wherein X is as defined above and an electron attractive group in a molecule as disclosed in JP-A 271344/1988; and compounds having a C—X' bond wherein X' is the same as X or —$SO_2$— and an electron attractive group in a molecule as disclosed in JP-A 271341/1988. Also useful are compounds which release a diffusible dye through cleavage of a single bond after reduction due to $\pi$-bond conjugated with an electron accepting group as disclosed in JP-A 161237/1989 and 161342/1989.

More preferred are the compounds having a N-X bond and an electron attractive group in a molecule, with examples being described in EP 220746 A2 or U.S. Pat. No. 4,783,396 as compounds (1)–(3), (7)–(10), (12), (13), (15), (23)–(26), (31), (32), (35), (40), (41), (44), (53)–(59), (64), and (70) and in Technical Report 87 - 6199 as compounds (11) to (23).

Class (4) includes couplers having a diffusible dye as an eliminatable group and thus releasing a diffusible dye through reaction with an oxidant of a reducing agent, known as DDR couplers, as described in British Patent No. 1,330,524, JP-B 39165/1973; U.S. Pat. Nos. 3,443,940, 4,474,867 and 4,483,914.

Class (5) includes compounds (DRR couplers) which themselves have reducing nature to silver halide or organic silver salts and release a diffusible dye upon reduction of the silver halide or organic silver salts. Without a need for an extra reducing agent, the DRR couplers eliminate the serious problem that an image can be contaminated with oxidation decomposition products of a reducing agent. Typical examples are described in the following patents:

| | | |
|---|---|---|
| U.S. Pat. No. 3,443,939 | 3,725,062 | 3,728,113 |
| 3,928,312 | 4,053,312 | 4,055,428 |
| 4,336,322 | 4,500,626 | |
| JP-A 65839/1984 | 69839/1984 | 116537/1983 |
| 179840/1982 | 3819/1978 | 104343/1976 |

as well as Research Disclosure 17465. Examples of the DRR compound are described in U.S. Pat. No. 4,500,626, columns 22–44, with preferred ones being identified as compounds (1)–(3), (10)–(13), (16)–(19), (28)–(30), (33)–(35), (38)–(40), and (42) –(64). Also useful are those described in U.S. Pat. No. 4,639,408, columns 37–39.

The dye releasing redox compound (i.e., DRR compound) which releases a hydrophilic diffusible dye for use in the present invention is preferably represented by the following general formula (I):

$$R\text{—}SO_2\text{—}D \qquad (I)$$

wherein R represents a reducing group capable of being oxidized by a silver halide or an organic silver salt oxidizing agent, and D represents an image forming dye portion containing a hydrophilic group.

Preferably the reducing group in the dye releasing compound $R\text{-}SO_2D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group include those represented by the following general formulae (II) to (IX).

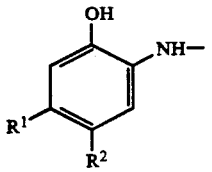
(II)

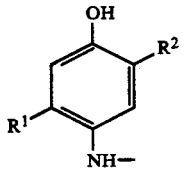
(III)

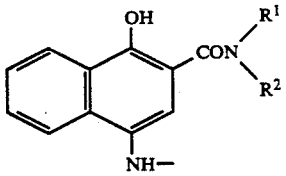
(IV)

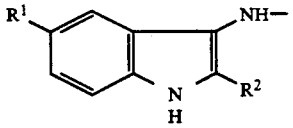
(V)

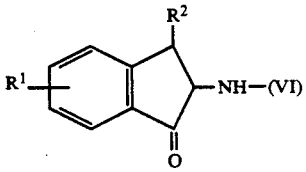
(VI)

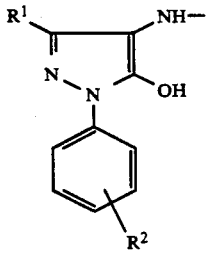
(VII)

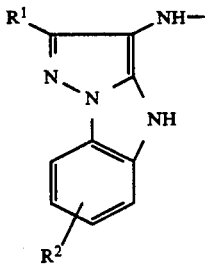
(VIII)

-continued

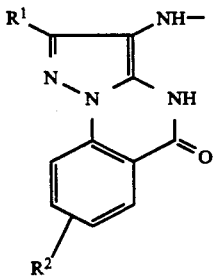
(IX)

wherein $R^1$ and $R^2$ each represents hydrogen or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. The total number of the carbon atoms of substituents represented by $R^1$ and $R^2$ is preferably from 8 to 40. Furthermore, the hydroxy group and the amino group included in the reducing group represented by R may be protected by a protective group capable of reducing the hydroxy group and the amino group by the action of a nucleophilic agent.

There are available dye providing compounds other than the aforementioned couplers and compounds of formula [L I]. Such additional dye-providing compounds include dye-silver compounds in which an organic silver salt is combined with a dye (see Research Disclosure, May 1978, pages 54–58); azo dyes useful in heat development silver dye bleaching process (see U.S. Pat. No. 4,235,957 and Research Disclosure, April 1976, pages 30–32); and leuco dyes (see U.S. Pat. Nos. 3,985,565 and 4,022,617).

Hydrophobic additives like dye-providing compounds and non-diffusible reducing agents may be introduced into a layer of photosensitive material by any desired method, for example, by the method described in U.S. Pat. No. 2,322,027. Use may be made of high-boiling organic solvents as described in JP-A 83154/1984, 178451/1984, 178452/1984, 178453/1984, 178454/1984, 178455/1984, and 178457/1984, optionally in combination with low-boiling organic solvents having a boiling point of 50° to 160° C. The amount of the high-boiling organic solvent used is generally up to 10 grams, preferably up to 5 grams per gram of the dye-providing compound and up to 1 cc, preferably up to 0.5 cc, more preferably up to 0.3 cc per gram of the binder.

A dispersion method using a polymer as disclosed in JP-B 39853/1976 and JP-A 59943/1976 may be used.

Substantially water-insoluble compounds may be dispersed in a binder as fine particles although any of the aforementioned addition methods may be used.

In dispersing hydrophobic compounds in hydrophilic colloids, a variety of surfactants may be used. Exemplary surfactants are found in JP-A 157636/1984, pages 37–38.

The photosensitive material according to the invention may further contain a compound capable of activating development and stabilizing an image at the same time. Examples are found in U.S. Pat. No. 4,500,626, columns 51–52.

In the system of forming images through diffusion transfer of dyes, a photosensitive material is used in combination with a dye fixing material or element. There are generally two typical forms, one form having photosensitive material and dye-fixing material separately applied on two separate supports and another form having both photosensitive material and dye-fixing material applied on a common support. With respect to the relation of the photosensitive material and the dye-fixing material to one another, to the support, and to a white reflective layer, reference may be made to U.S. Pat. No. 4,500,626, col. 57.

The dye-fixing material preferably used in the present invention has at least one layer containing a mordant and a binder. The mordant may be selected from those known in the photographic art, for example, the mordants described in U.S. Pat. No. 4,500,626, col. 58–59 and JP-A 88256/1986, pages 32–41; and the compounds described in JP-A 244043/1987 and 244036/1987. Also useful are dye accepting polymers as disclosed in U.S. Pat. No. 4,463,079.

If desired, the dye-fixing material may be provided with any auxiliary layer, for example, a protective layer, peeling layer, and anti-curling layer, in addition to the above-mentioned layers. Provision of a protective layer is especially effective.

One or more layers of the photosensitive material and dye-fixing material may contain a plasticizer, a lubricant, or a high-boiling organic solvent as an agent for facilitating stripping of the photosensitive material from the dye-fixing material. Examples are found in JP-A 253159/1987 and 245253/1987.

Moreover, various silicone fluids may be used for the same purpose as above. The silicone fluids include dimethylsilicone fluid and modified silicone fluids of dimethylsiloxane having organic radicals incorporated therein. Examples are the modified silicone fluids described in "Modified Silicone Oil Technical Data", Shin-Etsu Silicone K.K., pages 16–18B, especially carboxy-modified silicone (trade name X-22-3710). Also useful are the silicone fluids described in JP-A 215953/1987 and 46449/1988.

Various anti-fading agents may be used in the photosensitive material and dye-fixing material according to the invention. Exemplary anti-fading agents are antioxidants, UV absorbers and certain metal complexes. The antioxidants include chromans, coumarans, phenols (e.g., hindered phenols), hydroquinone derivatives, hindered amine derivatives, and spiroindanes. Also useful are the compounds described in JP-A 159644/1986. The UV absorbers include benzotriazoles (see U.S. Pat. No. 3,533,794, etc.), 4-thiazolidones (see U.S. Pat. No. 3,352,681, etc.), benzophenones (see JP-A 2784/1971, etc.), and the compounds described in JP-A 48535/1979, 136641/1987, and 88256/1986. Also useful are the compounds described in JP-A 260152/1987. Useful metal complexes are described in U.S. Pat. No. 4,241,155, U.S. Pat. No. 4,245,018, col. 3–36, U.S. Pat. No. 4,254,195, col. 3–8, JP-A 174741/1987, 88256/1986, pages 27–29, 199248/1988, and Japanese Patent Application Nos. 234103/1987 and 230595/1987. Other useful anti-fading agents are described in JP-A 215272/1987, pages 125–137.

For preventing the dye transferred to the dye-fixing material from fading, the anti-fading agent may be previously contained in the dye-fixing material or supplied to the dye-fixing material from the exterior, typically photosensitive material.

The above-mentioned antioxidants, UV absorbers and metal complexes may be used in combination.

Fluorescent brighteners may be used in the photosensitive material and dye-fixing material. Preferably, the brightener is incorporated in the dye-mixing material or supplied thereto from the exterior such as the photosensitive material. Exemplary brighteners are described in K. Veenkataraman, "The Chemistry of Synthetic Dyes", Vol. V, Chap. 8, and JP-A 143752/1986. Illustrative examples include stilbene compounds, coumarin compounds, biphenyl compounds, benzoxazolyl compounds, naphthalimide compounds, pyrazoline compounds, and carbostyryl compounds. The brightener may be combined with the anti-fading agent.

The photosensitive material of the present invention contains a dye capable of absorbing light in a certain wavelength range for the purposes of improving color separation and sharpness. Particularly when an infrared sensitive layer is included, an infrared absorbing dye is preferably contained therein. Preferred infrared absorbing dyes are indolenine dyes, especially water-insoluble indolenine dyes.

Hardeners are contained in silver halide emulsion layers and/or other photographic constituent layers. Examples of the hardener include aldehydes such as formaldehyde and glutaraldehyde; ketones such as diacetyl and cyclopentanedione; bis(2-chloroethylurea); 2-hydroxy-4,6-dichloro-1,3,5-triazine; compounds having reactive halogen as shown in U.S. Pat. Nos. 3,288,775, 2,732,303, 974,723 and 1,167,207; divinylsulfone; 5-acetyl-1,3-diacryloylhexahydro-1,3,5-triazine; compounds having reactive olefin as shown in U.S. Pat. Nos. 3,635,718, 3,232,763, 3,490,911, 3,642,486 and 994,869; N-hydroxymethylphthalimide; N-methylol compounds as shown in U.S. Pat. Nos. 2,732,316 and 2,586,168; isocyanates as shown in U.S. Pat. No. 3,103,437; aziridine compounds as shown in U.S. Pat. Nos. 3,017,280 and 2,983,611; acid derivatives as shown in U.S. Pat. Nos. 2,725,294 and 2,725,295; carbodiimide compounds as shown in U.S. Pat. No. 3,100,704; epoxy compounds as shown in U.S. Pat. No. 3,091,537; isooxazole compounds as shown in U.S. Pat. Nos. 3,321,313 and 3,543,292; halogenocarboxyaldehydes such as mucochloric acid; dioxane derivatives such as dihydroxydioxane and dichlorodioxane; and inorganic hardeners such as chromium alum and zirconium sulfate. Also useful hardeners are compounds of the formula:

$$CH_2{=}CHSO_2\underset{\underset{R}{|}}{CH}{-}(\underset{\underset{R}{|}}{CH})_n{-}SO_2CH{=}CH_2$$

wherein R is a hydrogen atom, alkyl group, aralkyl group, aryl group or heterocyclic group and n is 0 or 1. More particularly, R is a hydrogen atom, a substituted or unsubstituted alkyl group having 1 to 20 carbon atoms (e.g., methyl and ethyl), a substituted or unsubstituted aralkyl group having 6 to 20 carbon atoms (e.g., benzyl and phenethyl), a substituted or unsubstituted aryl group having 5 to 20 carbon atoms (e.g., phenyl and naphthyl) or a nitrogenous heterocyclic group having 5 or 6 members (e.g., pyridyl). Exemplary substituents are sulfonate, hydroxyl, and carboxyl groups. A hydrogen atom is the most preferred R.

Constituent layers of the dye-fixing material may contain hardeners, for example, those mentioned above as well as the hardeners described in U.S. Pat. No. 4,678,739, JP-A 116655/1984, 245261/1987, and 18942/1986. Illustrative examples include aldehyde hardeners (e.g., formaldehyde), aziridine hardeners, epoxy hardeners, vinylsulfon hardeners (e.g., N,N'-ethylene-bis(vinylsulfonylacetamide)ethane), N-methylol hardeners (e.g., dimethylol urea), and polymeric hardeners (e.g., the compounds described in JP-A 234157/1987).

The photosensitive material and dye-fixing material may contain a surfactant in any layer thereof for various purposes including coating aid, stripping improvement, lubrication, antistatic, and development acceleration. Useful surfactants are found in JP-A 173463/1987 and 183457/1987.

An organic fluorine compound may be contained in any layer of the photosensitive material and dye-fixing element for various purposes including lubrication, antistatic, and stripping improvement. Useful organic fluorine compounds are the fluoride surfactants described in JP-B 9053/1982, JP-A 20944/1986 and 135826/1987, and hydrophobic fluorine compounds including oily fluorine compounds such as fluoro-oil and solid fluorine compound resins such as tetrafluoroethylene resin.

A matte agent may be contained in any layer of the photosensitive material and dye-fixing material. Exemplary matte agents include silicon dioxide, polyolefins, polymethacrylate and other compounds as described in JP-A 88256/1986, and beads of benzoguanamine resin, polycarbonate resin, AS resin or the like as described in JP-A 274944/1988 and 274952/1988.

The photosensitive material and dye-fixing material may contain thermal solvents, defoaming agents, antifungal and antibacterial agents, colloidal silica or the like in any layer thereof. These additives are described in JP-A 88256/1986, pages 26–32.

Image formation promoters may also be used in the photosensitive material and/or dye-fixing material in the practice of the present invention. The image formation promoters have the functions of promoting such reactions as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physical-chemistry, they may be classified into bases, base precursors, nucleophilic compounds, high-boiling organic solvents (oils), thermal solvents, surfactants, and compounds capable of interacting with silver or silver ion. It should be noted that these compounds generally have multiple functions and thus possess some of the above-mentioned promoting effects combined. For further detail, reference is to be made to U.S. Pat. No. 4,678,739, col 38–40.

Base precursors are preferably those precursors which undergo any reaction under heat to release a base, for example, organic acid-base salts which are decomposed or decarbonated upon heating, and compounds which are decomposed to release amines through intramolecular nucleophilic substituting reaction, Lossen rearrangement or Beckman rearrangement. Examples are found in U.S. Pat. No. 4,511,493 and JP-A 65038/1987.

In a system wherein heat development and dye transfer are simultaneously carried out in the presence of a minor amount of water, the base and/or base precursor may be contained in the dye-fixing material because the photosensitive material is then improved in shelf stability.

Additionally, combinations of a difficultly soluble metal compound and a compound capable of reaction with a metal ion of said difficultly soluble metal compound to form a complex (complexing compound) as described in EP-A 210,660 and U.S. Pat. No. 4,740,445 and compounds which generate bases through electrolysis as described in JP-A 232451/1986 may also be used as the base precursor. The former is particularly effective. Advantageously, the difficultly soluble metal compound and complexing compound are separately added to the photosensitive material and dye-fixing element.

The photosensitive material and/or dye-fixing material may contain a development stopper for the purpose of providing consistent images at all times despite of variations in temperature and time of development. The development stopper used herein is a compound which quickly neutralizes a base or reacts with a base to reduce the base concentration in the film for terminating development or a compound which interacts with silver or a silver salt for suppressing development, both after optimum development has been done. Useful are acid precursors which release acids upon heating, electrophilic compounds which undergo substitution reaction with coexisting bases upon heating, nitrogenous heterocyclic compounds, mercapto compounds and precursors thereof. For detail, reference is made to JP-A 253159/1987.

The support used in the heat-developable photosensitive material and dye-fixing material according to the present invention may be of any desired material which can withstand the processing temperature. Typical supports are those of paper and synthetic polymers (film). Examples include films of polyethylene terephthalate (PET), polycarbonate, polyvinyl chloride, polystyrene, polypropylene, polyimide, and celluloses (e.g., triacetyl cellulose), those films having incorporated therein pigments such as titanium oxide, synthetic paper formed from polypropylene or the like, mix paper machined from synthetic resin pulp such as polyethylene and natural pulp, Yankee paper, baryta paper, coated paper (cast coated paper), metals, fabrics, and glass. These supports may be used alone or supports laminated with synthetic polymers such as polyethylene on one or both surfaces thereof be used. Also useful are the supports described in JP-A 253159/1987, pages 29–31.

The support on the surface may be coated with a hydrophilic binder and an antistatic agent such as a semiconductor metal oxide (e.g., alumina sol and tin oxide) and carbon black.

For exposing the photosensitive material imagewise to record images therein, a variety of exposure methods are employable. For example, exposure may be done by directly taking pictures of objects using a camera or the like; exposing through a reversal film or negative film using a printer, enlarger or the like; scanning an original and exposing through a slit using an exposure unit of a duplicating machine; actuating a light emitting diode, laser or the like to emit light for exposure in response to electrical signals representative of image information; or outputting image information on a display such as a CRT, liquid crystal display, electroluminescent display and plasma display and exposing directly or through an optical system.

A variety of light sources may be used for recording images in photosensitive material, for example, sunlight, tungsten lamps, light emitting diodes, laser light sources, CRT light sources and the like as described in U.S. Pat. No. 4,500,625, col. 56.

Also acceptable is imagewise exposure using a wavelength conversion element having a non-linear optical material combined with a coherent light source such as a laser. The non-linear optical material used herein is that material which when an intense photoelectric field as provided by laser light is applied, can develop polarization in non-linear relationship with the electric field. Examples include inorganic compounds such as lithium niobate, potassium dihydrogen phosphate (KDP), lithium iodate and $BaB_2O_4$; urea derivatives and nitroaniline derivatives, foe example, nitropyridine-N-oxide derivatives such as 3-methyl-4-nitropyridine-N-oxide (POM); and the compounds described in JP-A 53462/1986 and 210432/1987. The wavelength conversion elements include single crystal optical waveguide and fiber types which are both applicable.

The image information may be given in the form of image signals available from video cameras and electronic still cameras, television signals as represented by NTSC, image signals obtained by dividing an original into a multiplicity of pixels by means of a scanner, and image signals created by means of computers as represented by CG and CAD.

The photosensitive material and/or dye-fixing element may have a conductive heater layer as means for producing heat necessary for heat development or dye diffusion transfer. Transparent or non-transparent heater elements as described in JP-A 145544/1986 may be used. These conductive layers also serve as antistatic layers.

In heat developing the heat-developable color photosensitive material according to the invention, the heating temperature is about 50° C. to about 250° C., preferably about 80° C. to about 180° C. Dye diffusion transfer may be effected at the same time as heat development or after the completion of heat development. In the latter case, the heating temperature in the transfer step may be from room temperature to the temperature used in the heat development, preferably from about 50° C. to a temperature about 10° C. lower than the heat development temperature.

Dye transfer can be induced solely by heat although a solvent may be used for promoting dye transfer. It is also useful to heat in the presence of a minor amount of solvent (especially water) to carry out development and transfer simultaneously or sequentially as disclosed in JP-A 218443/1984 and 238056/1986. In this mode, the heating temperature is from 50° C. to below the boiling point of the solvent, for example, from 50° C. to 100° C. if the solvent is water.

Examples of the solvent which is used in order to promote development and/or allow the diffusible dye to migrate to the dye-fixing layer include water and basic aqueous solutions containing inorganic alkali metal salts and organic bases (which may be those previously described for the image formation promoter). Also, low-boiling solvents and mixtures of a low-boiling solvent and water or a basic aqueous solution are useful. Surfactants, anti-foggants, difficultly soluble metal salts and complexing compounds or the like may be contained in the solvents.

The solvent is used by applying it to the dye-fixing material or photosensitive material or both. The amount of the solvent used may be as small as below the weight of solvent corresponding to the maximum swollen volume of entire coatings, especially below the weight of solvent corresponding to the maximum swollen volume of entire coatings minus the dry weight of entire coatings.

Useful for applying the solvent to the photosensitive layer or dye-fixing layer is a method as disclosed in JP-A 147244/1986, page 26. It is also possible to seal the solvent in microcapsules and incorporate the microcapsules in the photosensitive material or dye-fixing material or both.

To promote dye transfer, a hydrophilic thermal solvent which is solid at room temperature, but melts at high temperature may be incorporated into the photosensitive material or dye-fixing material or both. The layer into which the thermal solvent is incorporated is not limited and may be selected from emulsion layers, intermediate layer, protective layer and dye-fixing layer. Preferably, the thermal solvent is incorporated into the dye-fixing layer and/or layers contiguous thereto. Examples of the hydrophilic thermal solvent include ureas, pyridines, amides, sulfonamides, imides, alcohols, oximes, and heterocyclics. To promote dye transfer, a high-boiling organic solvent may be incorporated into the photosensitive material or dye-fixing material or both.

Heating required in the development and/or transfer step may be carried out by any desired means, for example, by contacting with heated blocks or plates, contacting with hot plates, hot presses, hot rollers, halide lamp heaters, infrared or far infrared lamp heaters, or by passing through a hot atmosphere.

Pressure is applied in overlapping a photosensitive element and a dye-fixing element in close contact. Such pressure requirements and pressure application are described in JP-A 147244/1986, page 27.

For processing photographic elements according to the present invention, there may be used any of various developing apparatus including those described in JP-A 75247/1984, 177547/1984, 181353/1984 and 18951/1985 and Japanese U.M. Application Kokai No. 25944/1987.

EXAMPLE

Examples of the present invention are given below by way of illustration and not by way of limitation.

EXAMPLE 1

Zinc hydroxide dispersion

A dispersion of zinc hydroxide was prepared by adding 12.5 grams of zinc hydroxide having a mean particle size of 0.15 μm, 1 gram of carboxymethyl cellulose as a dispersant and 0.1 gram of sodium polyacrylate to 100 ml of a 4% gelatin aqueous solution, milling the mixture in a mill with glass beads having a mean diameter of 0.75 mm for 30 minutes, and removing the glass beads from the mixture.

Preparation of Emulsions (1), (2) & (3)

To a thoroughly agitated aqueous gelatin solution of the composition shown in Table 1, Solutions I and II of the compositions shown in Table 2 were added over 20 minutes at 60° C. Thereafter, Solutions III and IV of the compositions shown in Table 2 were added over 35 minutes. After water washing and desalting, 25 grams of gelatin was added to the solution, which was adjusted to pH 6.1 and pAg 8.0. The dispersion was then chemically sensitized optimum at 61° C. using triethylthiourea and 4-hydroxy-6-methyl-(1,3,3a,7)tetraazaindene. The optimum chemical sensitization means that a maximum sensitivity is achieved with an exposure of $10^{-4}$ sec. There was obtained a monodispersed emulsion, with the yield, grain size and crystal habit thereof being shown in Table 3.

TABLE 1

| | Aqueous solutions | | |
|---|---|---|---|
| | Emulsion | | |
| | (1) | (2) | (3) |
| $H_2O$ | 630 cc | 720 cc | 810 cc |
| Gelatin | 20 g | 22 g | 19 g |
| KBr | 0.1 g | 10 g | — |
| NaCl | 4 g | 2 g | 6 g |
| KI | — | 0.01 g | — |
| 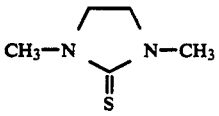 | 0.015 g | — | 0.03 g |

TABLE 2

| | Solutions I-IV | | | | | | | | | | | |
|---|---|---|---|---|---|---|---|---|---|---|---|---|
| | Emulsion (1) | | | | Emulsion (2) | | | | Emulsion (3) | | | |
| | I | II | III | IV | I | II | III | IV | I | II | III | IV |
| $AgNO_3$ (g) | 50 | — | 50 | — | 30 | — | 70 | — | 20 | — | 80 | — |
| KBr (g) | — | 21 | — | 28 | — | 21 | — | 47.6 | — | 13.3 | — | 36.4 |
| NaCl (g) | — | 6.9 | — | 3.5 | — | — | — | — | — | 0.5 | — | 9.6 |
| KI (g) | — | — | — | — | — | 1 | — | 2 | — | — | — | — |
| Water* (cc) | 250 | 250 | 200 | 400 | 300 | 300 | 500 | 600 | 100 | 100 | 400 | 400 |

*total volume

TABLE 3

| | Emulsion | | |
|---|---|---|---|
| | (1) | (2) | (3) |
| Yield | 610 g | 630 g | 615 g |
| Mean grain size | 0.30 μm | 0.38 μm | 0.37 μm |
| Crystal habit | cubic | octahedral | cubic |

Gelatin dispersions of dye-providing substances were prepared as follows.

To 70 cc of ethyl acetate were added 14.5 grams of magenta dye-providing substance (A), 0.21 grams of reducing agent (R), 0.20 grams of mercapto compound (1), 0.38 grams of surfactant (3), and 7.3 grams of high-boiling organic solvent (2). The mixture was heated to about 60° C. to form a uniform solution. This solution was mixed with 100 grams of 10% limed gelatin solution and 60 cc of water. The mixture was subjected to dispersion by a homogenizer at 10,000 rpm for 10 minutes. This dispersion is designated a magenta dye-providing substance dispersion.

To 50 cc of ethyl acetate were added 7.3 grams of cyan dye-providing substance (B1), 10.6 grams of cyan dye-providing substance (B2), 1.0 grams of reducing agent (R), 0.3 grams of mercapto compound (1), 0.38 grams of surfactant (3), and 9.8 grams of high-boiling organic solvent (1). The mixture was heated to about 60° C. to form a uniform solution. This solution was mixed with 100 grams of 10% limed gelatin solution and 60 cc of water. The mixture was subjected to dispersion by a homogenizer at 10,000 rpm for 10 minutes. This dispersion is designated a cyan dye-providing substance dispersion.

To 45 cc of ethyl acetate were added 17.3 grams of yellow dye-providing substance (C), 1.73 grams of filter dye (F), 1.2 grams of reducing agent (R), 0.15 grams of mercapto compound (1), 1.5 grams of surfactant (3), and 8.6 grams of high-boiling organic solvent (1). The mixture was heated to about 60° C. to form a uniform solution. This solution was mixed with 100 grams of 10% limed gelatin solution and 60 cc of water. The mixture was subjected to dispersion by a homogenizer at 10,000 rpm for 10 minutes. This dispersion is designated a yellow dye-providing substance dispersion.

Magenta dye-providing substance (A):

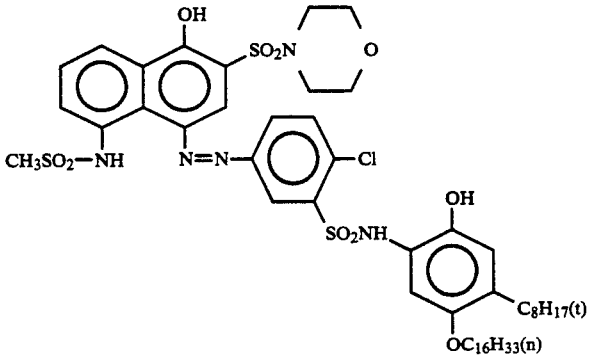

Cyan dye-providing substance (B1):

-continued
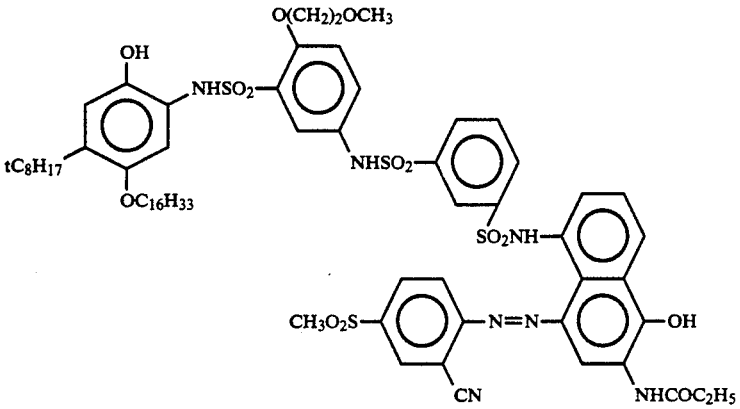
Cyan dye-providing substance (B2):
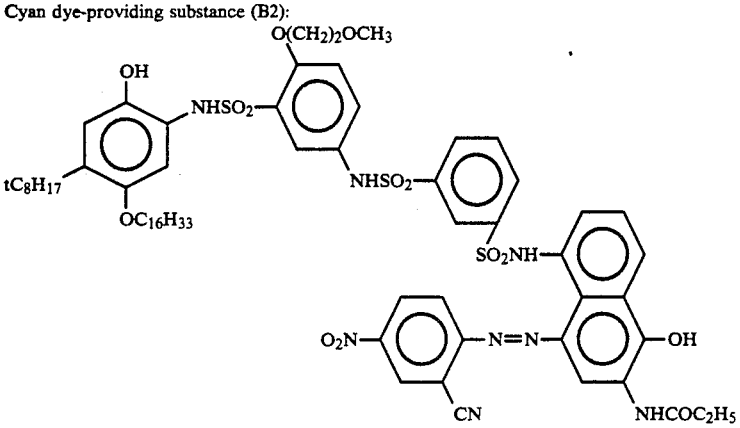
Yellow dye-providing substance (C)
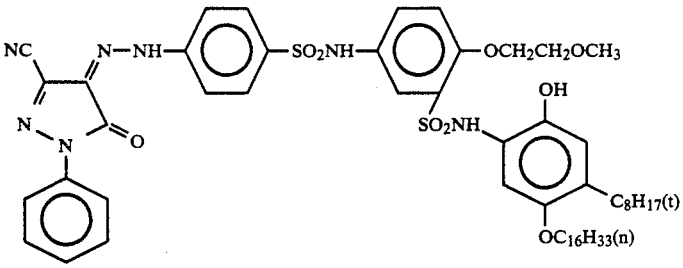
Reducing agent (R):
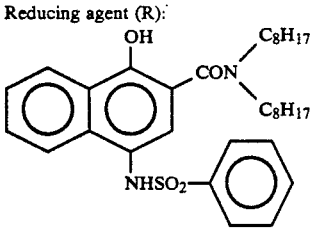
Mercapto compound (1):
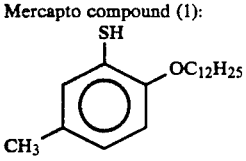
Surfactant (3):
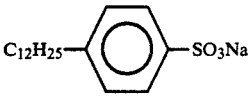

-continued

High-boiling organic solvent (1): triisononyl phosphate
High-boiling organic solvent (2): trihexyl phosphate
Filter dye (F):

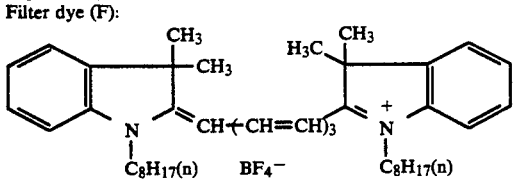

Using these and other materials, a heat-developable color photosensitive material No. 100 of the multilayer structure formulated in Table 4 was fabricated. The gelatin used in some layers of photosensitive material No. 100 had a calcium content of 2,700 ppm.

TABLE 4

| Photosensitive material No. 100 | |
|---|---|
| Additives | Coating weight (g/m$^2$) |
| 6th layer: protective layer | |
| Gelatin | 1.09 |
| Matte agent | 0.029 |
| Surfactant (1) | 0.063 |
| Surfactant (2) | 0.032 |
| Water-soluble polymer | 0.016 |
| Hardener | 0.058 |
| 5th layer: red (670 nm) sensitive layer | |
| Emulsion (1) | 0.27 of Ag |
| Sensitizing dye (1) | $8.5 \times 10^{-4}$ |
| Benzotriazole | $4.3 \times 10^{-3}$ |
| Magenta dye-providing substance (A) | 0.28 |
| High-boiling organic solvent (2) | 0.14 |
| Reducing agent (R) | $3.9 \times 10^{-3}$ |
| Mercapto compound (1) | $3.9 \times 10^{-3}$ |
| Surfactant (3) | $7.3 \times 10^{-3}$ |
| Gelatin | 0.29 |
| Water-soluble polymer | $8.5 \times 10^{-3}$ |
| 4th layer: intermediate layer | |
| Gelatin | 0.56 |
| $Zn(OH)_2$ | 0.39 |
| Surfactant (1) | $8.7 \times 10^{-3}$ |
| Surfactant (4) | 0.046 |
| Water-soluble polymer | 0.012 |
| 3rd layer: near infrared (750 nm) sensitive layer | |
| Emulsion (2) | 0.27 of Ag |
| Mercapto compound (2) | $3.8 \times 10^{-4}$ |

TABLE 4-continued

| Photosensitive material No. 100 | |
|---|---|
| Additives | Coating weight (g/m$^2$) |
| Sensitizing dye (2) | $1.1 \times 10^{-4}$ |
| Cyan dye-providing substance (B1) | 0.12 |
| Cyan dye-providing substance (B2) | 0.17 |
| High-boiling organic solvent (1) | 0.16 |
| Reducing agent (R) | 0.016 |
| Mercapto compound (1) | $4.1 \times 10^{-3}$ |
| Surfactant (3) | $6.1 \times 10^{-3}$ |
| Gelatin | 0.41 |
| Water-soluble polymer | 0.013 |
| 2nd layer: intermediate layer | |
| Gelatin | 0.63 |
| $Zn(OH)_2$ | 0.45 |
| Surfactant (1) | $6.17 \times 10^{-3}$ |
| Surfactant (4) | 0.057 |
| Water-soluble polymer | $9.2 \times 10^{-3}$ |
| 1st layer: infrared (810 nm) sensitive layer | |
| Emulsion (3) | 0.28 of Ag |
| Mercapto compound (2) | $7.9 \times 10^{-4}$ |
| Sensitizing dye (3) | $3.5 \times 10^{-5}$ |
| Yellow dye-providing substance (C) | 0.42 |
| Filter dye (F) | 0.042 |
| High-boiling organic solvent (1) | 0.21 |
| Reducing agent (R) | 0.029 |
| Mercapto compound (1) | $3.6 \times 10^{-3}$ |
| Surfactant (3) | 0.036 |
| Gelatin | 0.50 |
| Water-soluble polymer | 0.019 |
| Support: | |
| Polyethylene-laminated neutral paper (120 μm thick) | |

The components in Table 4 have the structural formulae shown below. The remainings are previously shown.

Surfactant (1): Aerosol OT
Surfactant (2):

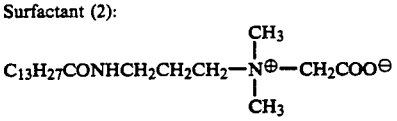

Surfactant (4):

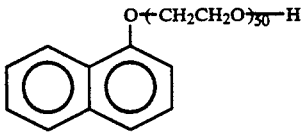

Water-soluble polymer:

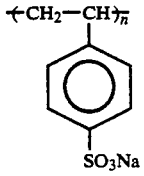

Hardener:

-continued $CH_2{=}CHSO_2CH_2\underset{\underset{OH}{|}}{C}HCH_2SO_2CH{=}CH_2$

Mercapto compound (2):

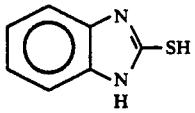

Sensitizing dye (1):

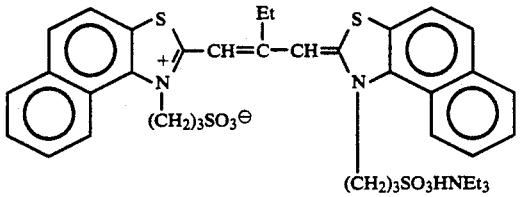

Sensitizing dye (2):

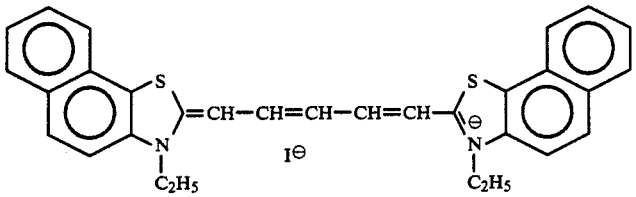

Sensitizing dye (3):

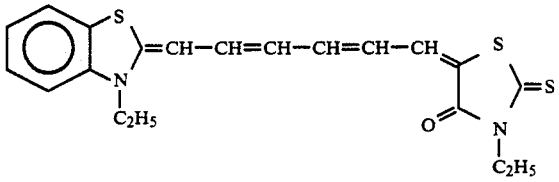

Next, a photosensitive material No. 101 was fabricated by the same procedure as No. 100 except that for all the relevant layers, the gelatin was replaced by delimed gelatin having a calcium content of 130 ppm.

Additionally, photosensitive material Nos. 102 to 107 were fabricated by the same procedure as No. 101 except that Ca $(NO_3)_2.4H_2O$ was added to some layers as shown in Table 5. The calcium nitrate was added to the coating solution from which each layer was formed.

TABLE 5

| | $Ca(NO_3)_2.4H_2O$ coating weight ($g/m^2$) | | | | | |
|---|---|---|---|---|---|---|
| | Photosensitive material No. | | | | | |
| Layer | 102 | 103 | 104 | 105 | 106 | 107 |
| 6th layer | 0.024 | 0 | 0 | 0.0097 | 0.014 | 0.0056 |
| 5th layer | 0 | 0 | 0.010 | 0 | 0 | 0 |
| 4th layer | 0 | 0.026 | 0 | 0 | 0 | 0 |
| 3rd layer | 0 | 0 | 0.015 | 0 | 0 | 0 |
| 2nd layer | 0 | 0.027 | 0 | 0 | 0 | 0 |
| 1st layer | 0 | 0 | 0.016 | 0 | 0 | 0 |
| Total | 0.024 | 0.053 | 0.041 | 0.0097 | 0.014 | 0.0056 |

The calcium content based on the total binder amount in these photosensitive materials is shown in Table 8.

Preparation of dye-fixing material

A dye-fixing material was prepared by laying up components on a polyethylene-laminated paper support in accordance with the formulation shown in Table 6.

TABLE 6

| | Dye-fixing material |
|---|---|
| Additives | Coating weight ($g/m^2$) |
| 3rd layer: | |
| Gelatin | 0.05 |
| Silicone oil*1 | 0.04 |
| Surfactant*2 | 0.001 |
| Surfactant*3 | 0.02 |
| Surfactant*4 | 0.10 |
| Guanidine picolinate | 0.45 |
| Polymer*5 | 0.24 |
| 2nd layer: | |
| Mordant*6 | 2.35 |
| Polymer*7 | 0.60 |
| Gelatin | 1.40 |
| Polymer*5 | 0.21 |
| High-boiling solvent*8 | 1.40 |
| Guanidine picolinate | 2.35 |
| Surfactant*2 | 0.02 |
| 1st layer: | |
| Gelatin | 0.45 |
| Surfactant*4 | 0.01 |
| Polymer*5 | 0.04 |
| Hardener*9 | 0.30 |
| Support polyethylene-laminated paper of 170 μm thick | |
| 1st back layer | |
| Gelatin | 3.25 |
| Hardener*9 | 0.25 |
| 2nd back layer | |
| Gelatin | 0.44 |

TABLE 6-continued

| Dye-fixing material | |
|---|---|
| Additives | Coating weight (g/m$^2$) |
| Silicone oil*1 | 0.08 |
| Surfactant*2 | 0.002 |
| Matte agent*10 | 0.09 |
| Surfactant*11 | 0.01 |

The components in Table 6 have the structural formulae shown below.

*1 Silicone oil:

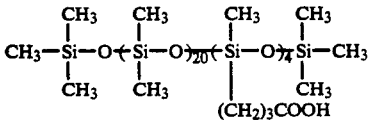

*2 Surfactant: Aerosol OT

*3 Surfacant:

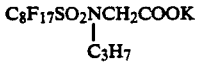

*4 Surfacant:

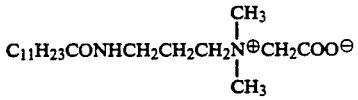

*5 Polymer: vinyl alcohol/sodium acrylate copolymer (75/25 molar ratio)

*6 Mordant:

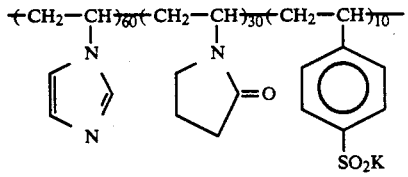

*7 Polymer: dextran (molecular weight 70,000)

*8 High-boiling solvent: Rheophos 95 (Ajinomoto K.K.)

*9 Hardener:

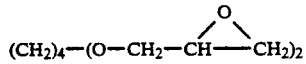

*10 Matter agent: benzoguanamine resin (18% by volume of particles of more than 10 μm size)

*11 Surfacant:

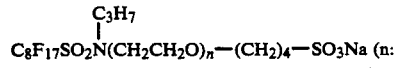

These photosensitive materials were evaluated by the following exposure and processing. Using a laser exposure apparatus as described in Japanese Patent Application No. 129625/1990, each photosensitive material was exposed under the following conditions.

TABLE 7

| Exposure conditions | |
|---|---|
| Beam intensity on photosensitive material surface: | 1 mW |
| Scanning line density: | 800 dpi (32 rasters/mm) |
| Beam diameter: | 100 ± 10 μm in primary scanning direction<br>80 ± 10 μm in subordinate scanning direction |
| Exposure time: | 0.9 msec./raster |
| Exposure wavelength: | 670, 750, 810 nm (laser light) |
| Exposure quantity: | a variation of 1 logE/2.5 cm in subordinate scanning direction |

TABLE 7-continued

| Exposure conditions | |
|---|---|
| Exposure quantity control: | light emitting time modulation |

After 12 cc/m$^2$ of water was supplied to the emulsion surface of the exposed photosensitive material by means of a wire bar, a dye-fixing material was placed on the wet photosensitive material such that their effective surfaces contacted each other. Using a heating drum, the assembly was heated such that the water-absorbed coating reached a temperature of 83° C. for 25 seconds. The dye fixing material which now born an image thereon was then stripped from the photosensitive material.

For each of the resulting images, the fog density Dmin was measured as well as the image density Dmax of Yellow, Magenta and Cyan. The results are shown in Table 8.

TABLE 8

| Photosensitive material No. | Calcium content | Dmin | | | Dmax | | |
|---|---|---|---|---|---|---|---|
| | | $D_R$ | $D_G$ | $D_B$ | C | M | Y |
| 100 | 2700 ppm | 0.12 | 0.14 | 0.06 | 2.56 | 2.18 | 1.94 |
| 101* | 130 ppm | 0.20 | 0.22 | 0.12 | 2.10 | 1.76 | 1.83 |
| 102 | 1300 ppm | 0.14 | 0.16 | 0.07 | 2.47 | 2.06 | 1.92 |
| 103 | 2700 ppm | 0.12 | 0.14 | 0.06 | 2.57 | 2.17 | 1.95 |
| 104 | 2100 ppm | 0.12 | 0.15 | 0.06 | 2.56 | 2.11 | 1.94 |
| 105 | 600 ppm | 0.15 | 0.17 | 0.09 | 2.36 | 1.98 | 1.90 |
| 106 | 800 ppm | 0.15 | 0.17 | 0.08 | 2.42 | 2.03 | 1.91 |
| 107* | 400 ppm | 0.18 | 0.20 | 0.11 | 2.27 | 1.90 | 1.86 |

*outside the scope of the invention

As seen from Table 8, the photosensitive materials within the scope of the invention form images with low Dmin and high Dmax.

There has been described a heat-developable color photosensitive material characterized by a high image density, clearer white areas and low cost.

While there have been described herein what are considered to be preferred embodiments of the present invention, other modifications of the invention shall be apparent to those skilled in the art from the teachings herein. It is, therefore, desired to be secured in the appended claims all such modifications as fall within the true spirit and scope of the invention.

I claim:

1. A heat-developable color photosensitive material comprising at least a photosensitive silver halide, a dye providing compound, a surfactant and a binder on a support, said photosensitive material containing calcium in an amount of 2,000 to 10,000 parts by weight per million parts by weight of the total binder, wherein the dye providing compound is a silver halide reducing agent which releases a diffusible dye upon reduction of silver halide by the dye providing compound.

2. The photosensitive material of claim 1 wherein the binder is gelatin.

3. The photosensitive material of claim 1, wherein the dye providing compound releases a diffusible dye in proportion to the reduction of silver ion of the photosensitive silver halide by the dye providing compound in exposed and heated portions of the photosensitive material.

4. The photosensitive material of claim 1 which does not contain a silver halide reducing agent other than said dye providing compound.

5. The photosensitive material of claim 1, wherein the surfactant is an anionic surfactant.

6. The photosensitive material of claim 1, wherein the dye providing compound is represented by formula (I):

$$R—SO_2—D \quad (I)$$

wherein R represents a reducing group capable of being oxidized by the photosensitive silver halide, and D represents an image forming dye portion containing a hydrophilic group.

7. The photosensitive material of claim 6, wherein the reducing group R is represented by one of formulae (II) to (IX):

(II)

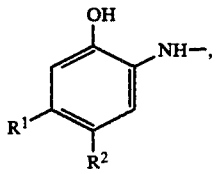

(III)

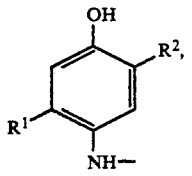

(IV)

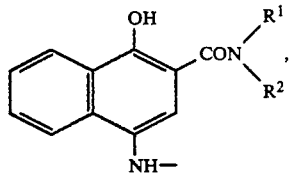

(V)

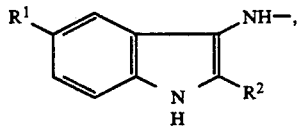

(VI)

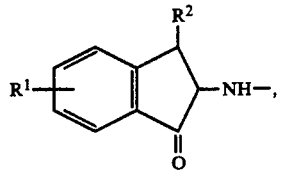

(VII)

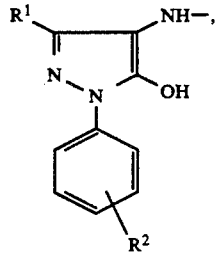

-continued (VIII)

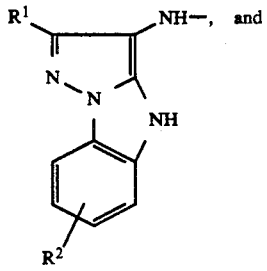

(IX)

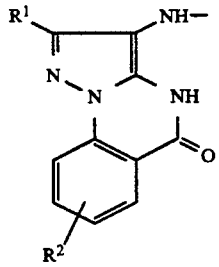

wherein $R^1$ and $R^2$ each represents hydrogen or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group.

8. A heat-developable color photosensitive material comprising at least a photosensitive silver halide, an organic silver salt, a dye providing compound, a surfactant and a binder on a support, said photosensitive material containing calcium in an amount of 2,000 to 10,000 parts by weight per million parts by weight of the total binder, wherein the dye providing compound is a silver halide reducing agent or an organic silver salt reducing agent which releases a diffusible dye upon reduction of silver halide or an organic silver salt by the dye providing compound.

9. The photosensitive material of claim 8, wherein the binder is gelatin.

10. The photosensitive material of claim 8, wherein the dye providing compound releases a diffusible dye in proportion to the reduction of silver ion of the photosensitive silver halide by the dye providing compound in exposed and heated portions of the photosensitive material.

11. The photosensitive material of claim 8 which does not contain a reducing agent to silver halide or an organic silver salt other than the dye providing compound.

12. The photosensitive material of claim 8, wherein the surfactant is an anionic surfactant.

13. The photosensitive material of claim 8, wherein the dye providing compound is represented by formula (I):

$$R—SO_2—D \quad (I)$$

wherein R represents a reducing group capable of being oxidized by the photosensitive silver halide or the organic silver salt, and D represents an image forming dye portion containing a hydrophilic group.

14. The photosensitive material of claim 13, wherein the reducing group R is represented by one of formulae (II) to (IX):

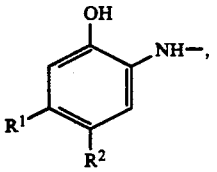
(II)

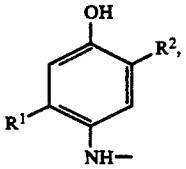
(III)

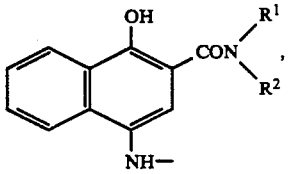
(IV)

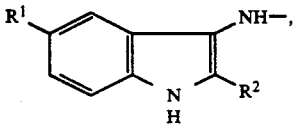
(V)

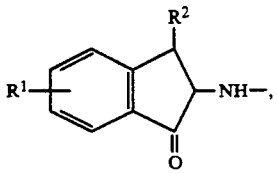
(VI)

-continued

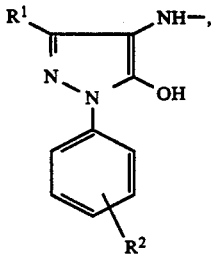
(VII)

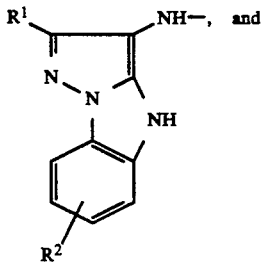
(VIII)

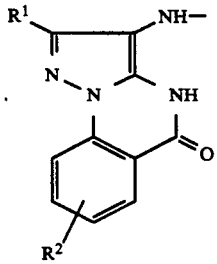
(IX)

wherein $R^1$ and $R^2$ each represents hydrogen or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group.

* * * * *